US011602249B2

(12) United States Patent
Yang

(10) Patent No.: US 11,602,249 B2
(45) Date of Patent: Mar. 14, 2023

(54) CHILDREN'S TOILET BOWL WITH ADJUSTABLE HEIGHT

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 18 days.

(21) Appl. No.: 17/244,981

(22) Filed: Apr. 30, 2021

(65) Prior Publication Data

US 2022/0183517 A1 Jun. 16, 2022

(30) Foreign Application Priority Data

Dec. 11, 2020 (CN) ..... 202022964781.X

(51) Int. Cl.
*A47K 13/10* (2006.01)
*A47K 11/06* (2006.01)
*A47K 11/04* (2006.01)

(52) U.S. Cl.
CPC ..... *A47K 13/10* (2013.01); *A47K 11/04* (2013.01); *A47K 11/06* (2013.01)

(58) Field of Classification Search
CPC ..... A47K 3/024; A47K 13/10; A47K 11/04; A47K 11/06; A47K 10/22; A47D 1/004; A47D 1/103; A47C 3/26
See application file for complete search history.

(56) References Cited

U.S. PATENT DOCUMENTS 4,199,826 A * 4/1980 Devereux ..... A47K 11/02 4/479
4,266,306 A * 5/1981 Lee ..... A47K 3/024 248/408
7,673,940 B2 * 3/2010 Fritz ..... A47D 1/103 297/250.1
8,276,219 B2 * 10/2012 Dubiel ..... A47K 11/06 4/479

(Continued)

FOREIGN PATENT DOCUMENTS

GB 2434981 * 8/2007 ..... A47K 11/06
KR 101733175 * 5/2017 ..... A47K 10/32

*Primary Examiner* — David P Angwin
*Assistant Examiner* — Nicholas A Ros
(74) *Attorney, Agent, or Firm* — Bayramoglu Law Offices LLC

(57) ABSTRACT

A children's toilet bowl with an adjustable height includes a base, a lifting seat and a seat cushion. The lifting seat has a vertical through structure. The upper part of the base extends into the lifting seat, and the seat cushion is disposed on the top surface of the lifting seat. Two liftable clamping members and two buttons configured to drive the corresponding liftable clamping members to rise and lower are disposed in the lifting seat. Two groups of clamping ladders are disposed on side surfaces of the base, and each group of clamping ladders corresponds to one liftable clamping member. The clamping ladder is provided with a plurality of clamping slots which are arranged at intervals from top to bottom, and the liftable clamping member is engaged with the clamping slot. The buttons are used to drive the rising and lowering of the corresponding liftable clamping members.

8 Claims, 5 Drawing Sheets

(56) References Cited

U.S. PATENT DOCUMENTS

| | | | | |
|---|---|---|---|---|
| 9,027,173 | B2 * | 5/2015 | Dunn | E03D 9/007 4/476 |
| 9,596,965 | B2 * | 3/2017 | Sundberg | A47K 13/00 |
| 2004/0133971 | A1 * | 7/2004 | Davis | A47K 11/06 4/483 |
| 2008/0178379 | A1 * | 7/2008 | Davis | A47K 11/06 4/483 |

* cited by examiner

CHILDREN'S TOILET BOWL WITH ADJUSTABLE HEIGHT

CROSS REFERENCE TO THE RELATED APPLICATIONS

This application is based upon and claims priority to Chinese Patent Application No. 202022964781.X, filed on Dec. 11, 2020, the entire contents of which are incorporated herein by reference.

TECHNICAL FIELD

The present invention relates to the field of children's products, and more particularly, to a children's toilet bowl with an adjustable height.

BACKGROUND

In order to provide convenience for children when they use the toilet bowl, at present there are various shapes of children's toilet bowls on the market, but the height of prior toilets cannot be adjusted. Since children are of different heights, the children's toilet bowl with a fixed height cannot meet the use requests of some children. For example, if the height of the children's toilet is excessively high, some children's feet cannot touch the ground, and sitting will make them more tired. If the height of the children's toilet is excessively low, some children's legs need to be bent greatly or their feet need to be stretched. These cases will bring discomfort for the children when they use the toilet bowl.

SUMMARY

The present invention provides a children's toilet bowl with an adjustable height, aimed to overcome the problem that the height of the prior children's toilet bowl cannot be adjusted.

In order to resolve the above technical problem, the present invention adopts the following technical solution.

A children's toilet bowl with an adjustable height includes a base, a lifting seat and a seat cushion. The lifting seat has a vertical through structure. The upper part of the base extends into the lifting seat, and the seat cushion is disposed on the top surface of the lifting seat. Two liftable clamping members and two buttons configured to drive the corresponding clamping members to rise and lower are disposed in the lifting seat. Two groups of clamping ladders are disposed on side surfaces of the base, and each group of clamping ladders corresponds to one clamping member. The clamping ladder is provided with a plurality of clamping slots which are arranged at intervals from top to bottom, and the clamping members are engaged with the clamping slots.

Two receiving spaces are disposed between the outer side wall of the base and the inner side wall of the lifting seat, and a lifting member is disposed in the two receiving spaces, respectively. The lifting member is fixedly connected to the lifting seat. The button is lifted and disposed on the lifting member, and each of the two clamping members is disposed on the lifting member in the two receiving spaces.

The button includes a pressing portion and a driving rod. The top of the driving rod is connected to the bottom of the pressing portion. The lower part of the driving rod is provided with a first notch, and the bottom surface of the first notch is a first inclined surface. The inner side of the clamping member is provided with a second notch, and a side surface of the second notch is a second inclined surface attached to the first inclined surface. The inner side surface of the clamping member is provided with two clamping portions arranged at an interval. The lifting member is provided with a limiting slot adapted to the clamping member, and the clamping member is located in the limiting slot. Two return springs are disposed between the outer side surface of the clamping member and the inner side surface of the lifting member. Each group of clamping ladders includes two clamping ladders, and each clamping ladder corresponds to one clamping portion. The clamping portion is adapted to the clamping slots.

The outer side surface of the lifting member is provided with a pressing groove, and the pressing groove is recessed inwardly to receive a hand. The top surface of the pressing groove is provided with a through groove adapted to the pressing portion. The back surface of the pressing groove is provided with two limiting posts. The upper part of the driving rod is provided with two slide grooves corresponding to and adapted to the two limiting posts. The two limiting posts are located in the corresponding slide grooves, respectively. A locking member connected to the two limiting posts is disposed on the inner side of the driving rod.

The side surfaces of the base are provided with two groups of clamping ladder slots, and each group of clamping ladder slots includes two clamping ladder slots. Each clamping ladder corresponds to and is adapted to one clamping ladder slot, and each clamping ladder is located in the corresponding clamping ladder slot. The back surface of the clamping ladder slot is provided with a connecting protrusion, and the top surface of the connecting protrusion is provided with a first locking hole. The top surface of the clamping ladder extends inwardly to form a connecting portion, and the connecting portion is provided with a second locking hole. The clamping ladder is connected to the connecting protrusion after a screw passes through the second locking hole and the first locking hole.

Each of the front end surface and the rear end surface of the base is provided with a limiting groove, and each of the front inner side surface and the rear inner side surface of the lifting seat is provided with a limiting protrusion. The limiting protrusion is located in the corresponding limiting groove.

The middle portion of the seat cushion is provided with a toilet bowl receiving cavity, and the toilet bowl receiving cavity includes an open top surface. A toilet bowl is placed in and adapted to the toilet bowl receiving cavity. A seat cushion ring and a toilet bowl cover are arranged on the top surface of the seat cushion, and the toilet bowl cover is hinged with the seat cushion. The toilet bowl cover is adapted to the seat cushion ring.

The top surface of the seat cushion is provided with a plurality of embedded grooves, and the bottom surface of the seat cushion ring is provided with a plurality of embedding portions. Each embedded groove corresponds to one embedding portion, and each embedding portion is adapted to and located in the corresponding embedded groove.

A protrusion is formed at the rear end of the seat cushion, and a cavity for placing paper towels is formed inside the protrusion. The rear end of the protrusion is provided with a placement opening. A rear cover covers on and is adapted to the placement opening. The top surface of the protrusion is provided with a paper extraction opening.

As can be known from the above description of the present invention, compared with the prior art, the present invention has the following advantages. The present invention has a novel structure and a clever design. The buttons are used to drive the rising and lowering of the corresponding clamping members. When two buttons are pressed simultaneously, two clamping members and the lifting seat can rise and lower. At this time, users can choose the clamping slot and the clamping member at proper positions to be engaged with each other, so as to adapt to the use of children of different heights and enable the children to feel more comfortable when they use the toilet bowl.

DETAILED DESCRIPTION OF THE EMBODIMENTS

Figure 1:
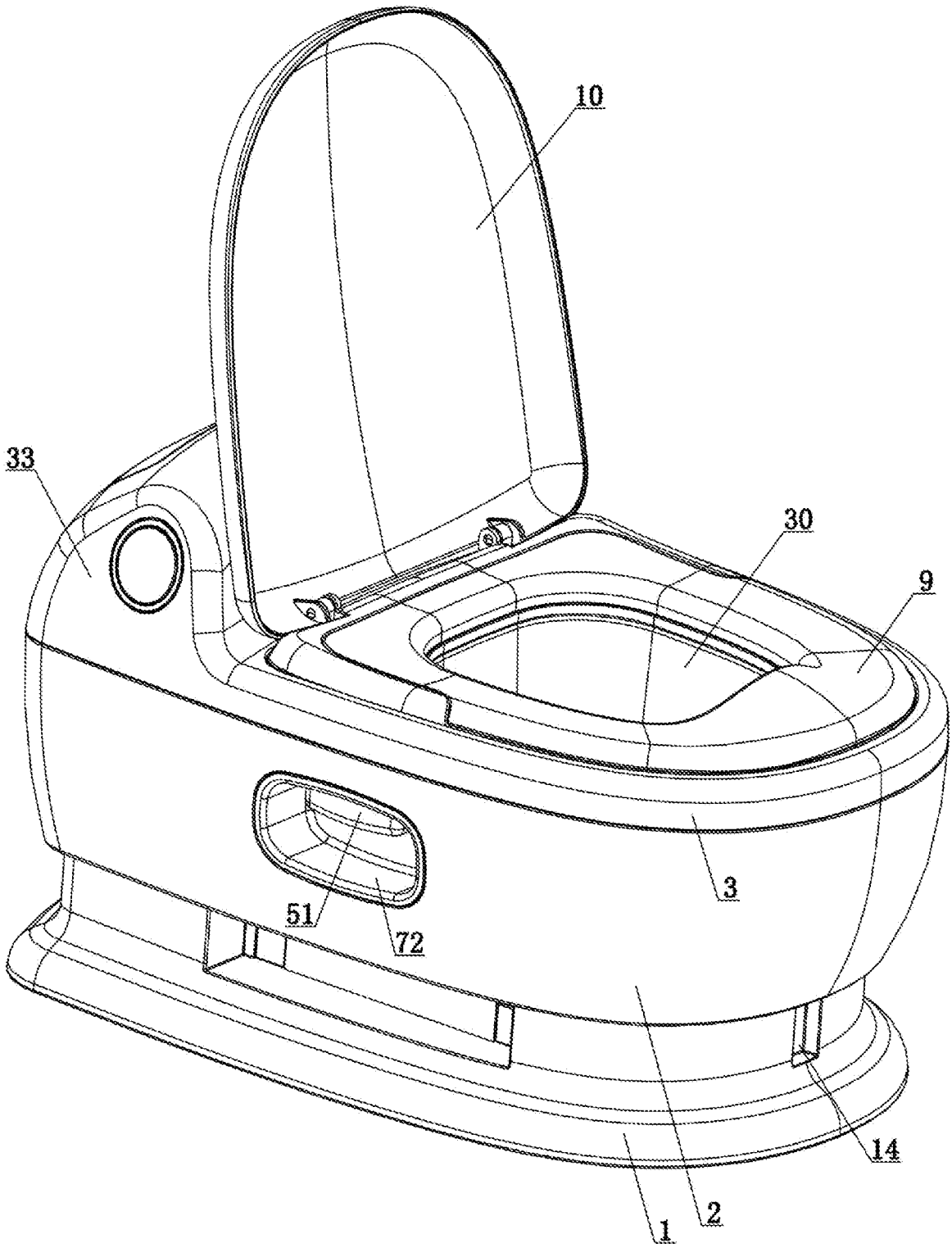
FIG. 1 is a schematic diagram of the structure of the present invention.

Referring to FIGS. 1, 3, 4 and 5, a children's toilet bowl with an adjustable height, includes the base 1, the lifting seat 2 and the seat cushion 3. The lifting seat 2 has a vertical through structure. The upper part of the base 1 extends into the lifting seat 2, and the seat cushion 3 is disposed on the top surface of the lifting seat 2. Two liftable clamping members 4 and two buttons 5 configured to drive the corresponding clamping members 4 to rise and lower are disposed in the lifting seat 2. Two groups of clamping ladders 6 are disposed on side surfaces of the base 1, and each group of clamping ladders 6 corresponds to one clamping member 4. The clamping ladder 6 is provided with a plurality of clamping slots 61 which are arranged at intervals from top to bottom, and the clamping members 4 may be engaged with the clamping slots 61. Two receiving spaces are disposed between the outer side wall of the base 1 and the inner side wall of the lifting seat 2, and the lifting member 7 is disposed in the two receiving spaces, respectively. The lifting member 7 is fixedly connected to the lifting seat 2. The button 5 is lifted and disposed on the lifting member 7, and each of the two clamping members 4 is disposed on the lifting member 7 in the two receiving spaces.

Referring to FIGS. 1, 3, 4, 5 and 6, the button 5 includes the pressing portion 51 and the driving rod 52. The top of the driving rod 52 is connected to the bottom of the pressing portion 51. The lower part of the driving rod 52 is provided with the first notch 53, and the bottom surface of the first notch 53 is the first inclined surface 54. The inner side of the clamping member 4 is provided with the second notch 41, and the side surface of the second notch 41 is the second inclined surface 42 attached to the first inclined surface 54. The inner side surface of the clamping member 4 is provided with two clamping portions 43 arranged at an interval. The lifting member 7 is provided with the limiting slot 71 adapted to the clamping member 4, and the clamping member 4 is located in the limiting slot 71. Two return springs 8 are disposed between the outer side surface of the clamping member 4 and the inner side surface of the lifting member 7. Each group of clamping ladders 6 includes two clamping ladders 6, and each clamping ladder 6 corresponds to one clamping portion 43. The clamping portion 43 is adapted to the clamping slots 61.

Referring to FIGS. 1, 3, 5 and 6, the outer side surface of the lifting member 7 is provided with the pressing groove 72, and the pressing groove 72 is recessed inwardly to receive a hand. The top surface of the pressing groove 72 is provided with the through groove 73 adapted to the pressing portion 51. The back surface of the pressing groove 72 is provided with two limiting posts 74. The upper part of the driving rod 52 is provided with two slide grooves 55 corresponding to and adapted to the two limiting posts 74. The two limiting posts 74 are located in the corresponding slide grooves 55, respectively. The locking member 8 connected to the two limiting posts 74 is disposed on the inner side of the driving rod 52, and the locking member 8 is connected to and locks the two limiting posts 74 by a screw.

Figure 3:
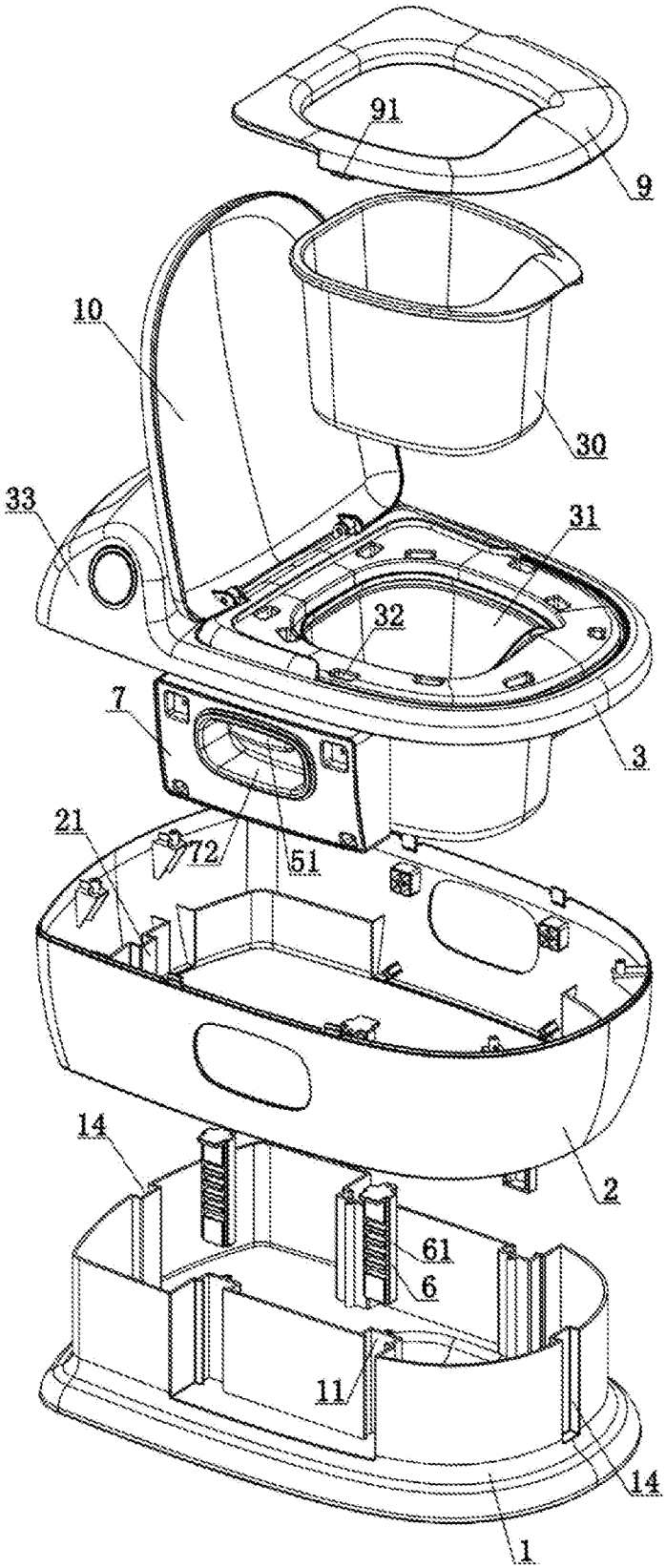
FIG. 3 is an exploded view of the structure of the present invention.
Figure 4:
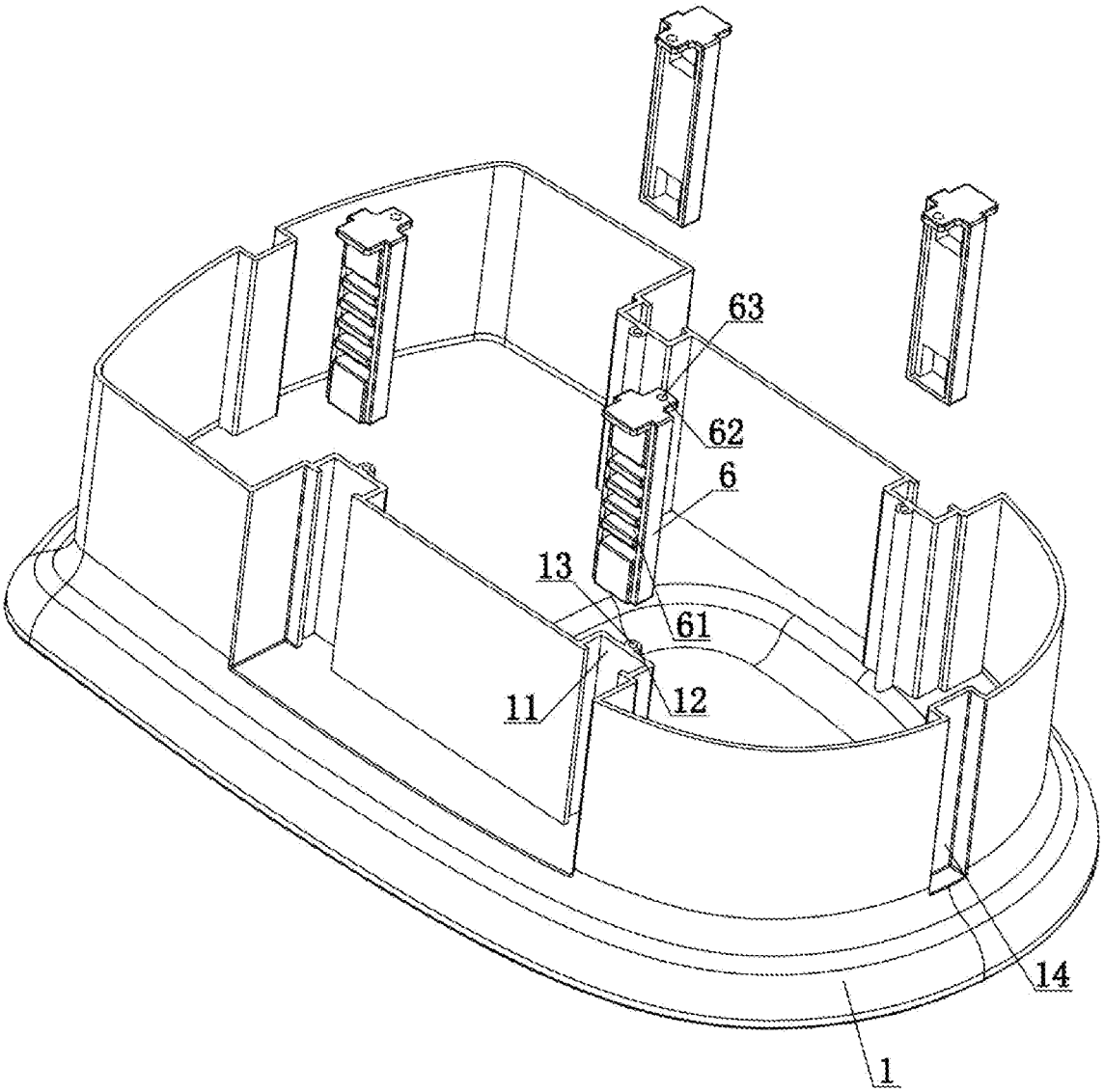
FIG. 4 is an exploded view of the structure of a base of the present invention.
Figure 5:
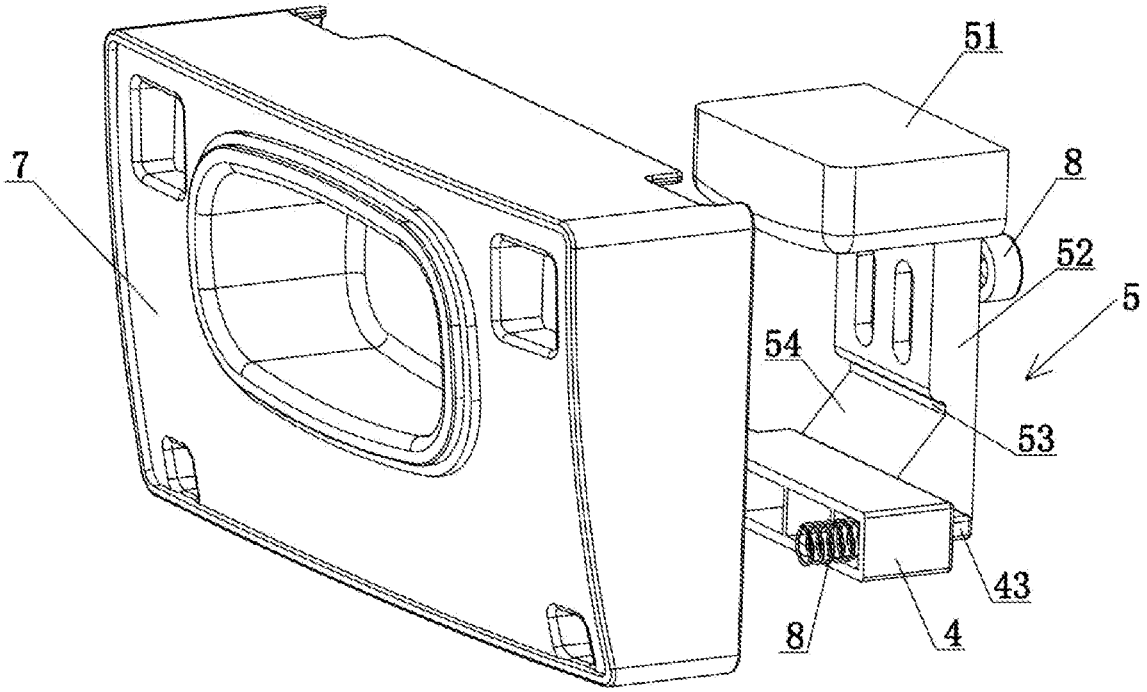
FIG. 5 is an exploded view of the structure of a lifting member, a clamping member and a button of the present invention.
Figure 6:
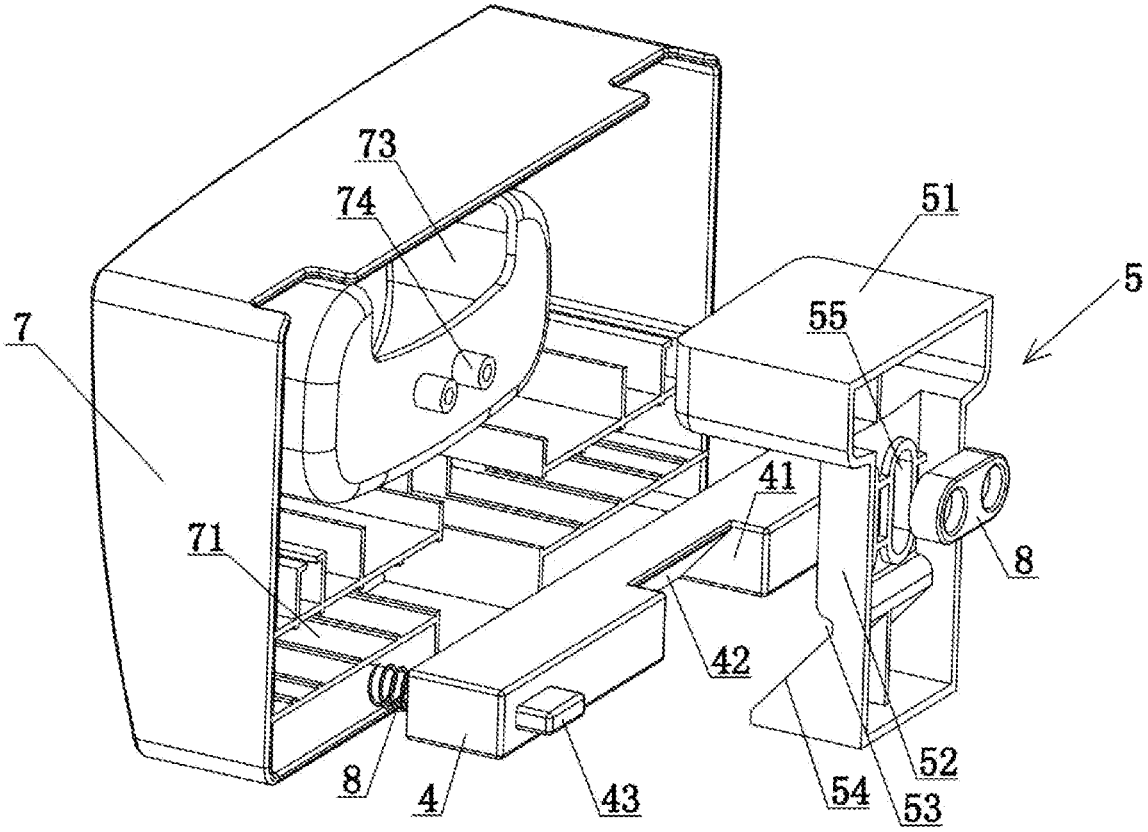
FIG. 6 is a schematic diagram of the structure of FIG. 5 from another perspective.

Referring to FIGS. 1, 3 and 4, the side surfaces of the base 1 are provided with two groups of clamping ladder slots 11, and each group of clamping ladder slots 11 includes two clamping ladder slots 11. Each clamping ladder 6 corresponds to and is adapted to one clamping ladder slot 11, and each clamping ladder 6 is located in the corresponding clamping ladder slot 11. The back surface of the clamping ladder slot 11 is provided with the connecting protrusion 12, and the top surface of the connecting protrusion 12 is provided with the first locking hole 13. The top surface of the clamping ladder 6 extends inwardly to form the connecting portion 62, and the connecting portion 62 is provided with the second locking hole 63. The clamping ladder 6 is connected to the connecting protrusion 12 after a screw passes through the second locking hole 63 and the first locking hole 13.

Referring to FIGS. 1 and 3, each of the front end surface and the rear end surface of the base 1 is provided with the limiting groove 14, and each of the front inner side surface and the rear inner side surface of the lifting seat 2 is provided with the limiting protrusion 21. The limiting protrusion 21 is located in the corresponding limiting groove 14. The limiting protrusion 21 and the limiting groove 14 cooperate to ensure that the lifting seat 2 stably rises and lowers on the base 1.

Figure 2:
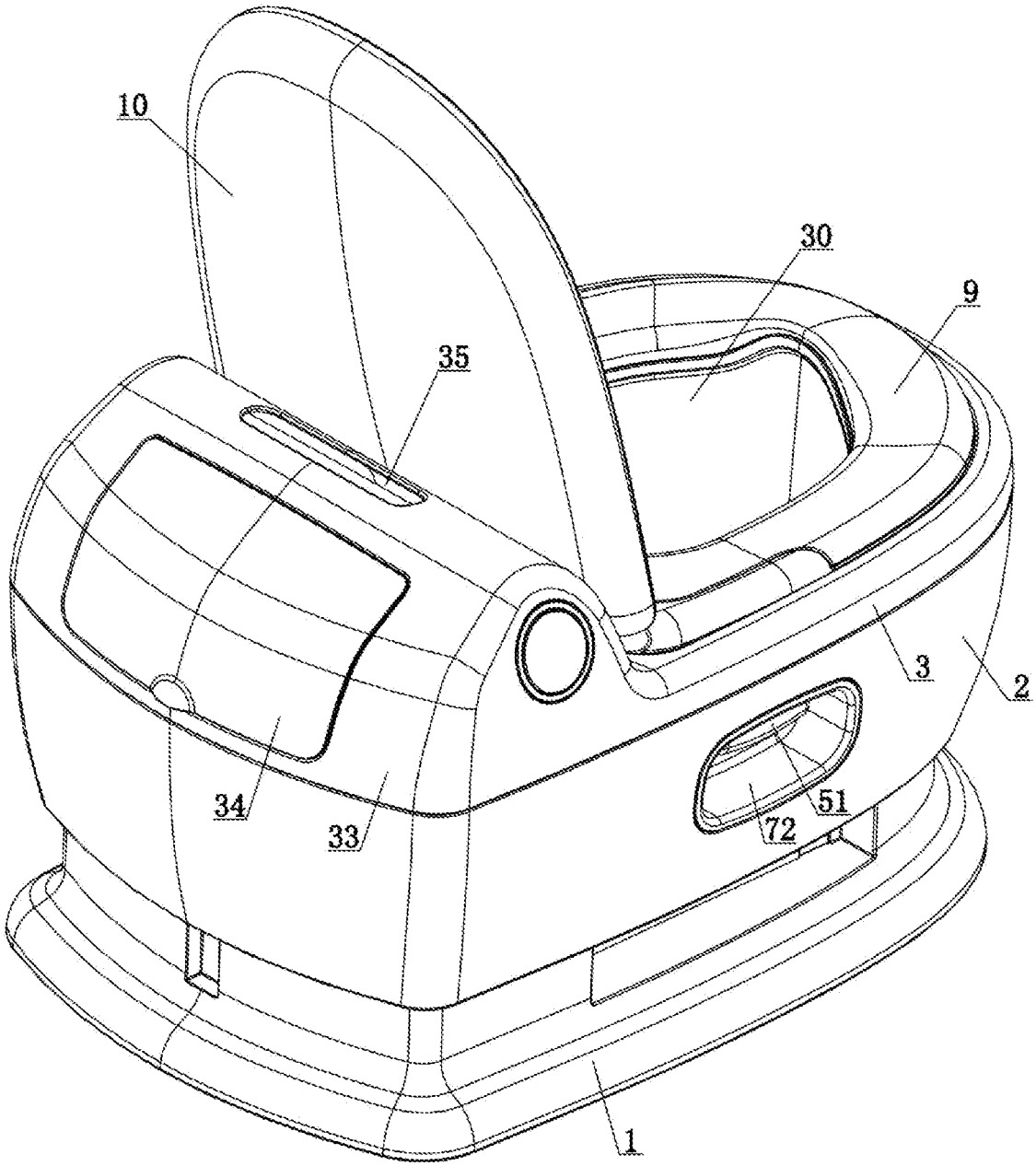
FIG. 2 is a schematic diagram of the structure of the present invention from another perspective.

Referring to FIGS. 2 and 3, the middle portion of the seat cushion 3 is provided with the toilet bowl receiving cavity 31, and the toilet bowl receiving cavity 31 includes an open top surface. The toilet bowl 30 is placed in and adapted to the toilet bowl receiving cavity 31. The seat cushion ring 9 and the toilet bowl cover 10 are arranged on the top surface of the seat cushion 3, and are hinged with the seat cushion 3. The toilet bowl cover 10 is adapted to the seat cushion ring 9. The top surface of the seat cushion 3 is provided with a plurality of embedded grooves 32, and the bottom surface of the seat cushion ring 9 is provided with a plurality of embedding portions 91. Each embedded groove 32 corresponds to one embedding portion 91, and each embedding portion 91 is adapted to and located in the corresponding embedded groove 32. The protrusion 33 is formed at the rear end of the seat cushion 3, and a cavity for placing paper towels is formed inside the protrusion 33. The rear end of the protrusion 33 is provided with a placement opening. The rear cover 34 covers on and is adapted to the placement opening, and can be turned up. The top surface of the protrusion 33 is provided with the paper extraction opening 35.

Referring to FIGS. 1, 3, and 4-6, the design principle of the present invention is as follows. When the height of the children's toilet bowl needs to be adjusted, the two buttons 5 are pressed simultaneously to enable the two buttons 5 to rise. By means of the shape design of the first inclined surface 54 and the second inclined surface 42, when the driving rod 52 rises, the clamping member 4 will move outwardly, and the clamping portion 43 can be separated from the clamping slot 61. When the lifting seat 2 is adjusted to a proper height, the buttons 5 are released, and the driving rod 52 lowers. The clamping member 4 moves inwardly under the action of the return spring 8, and the clamping portion 43 is then clamped into the proper clamping slot 61, so that the lifting seat 2 and the base 1 are releasably secured.

The above only describes specific embodiments of the present invention, but the design concept of the present invention is not limited hereto. Any non-substantial modification of the present invention using this concept shall fall within the scope of protection of the present invention.

What is claimed is:

1. A children's toilet bowl with an adjustable height, comprising a base, a lifting seat, and a seat cushion;

wherein the lifting seat has a vertical through structure; an upper part of the base extends into the lifting seat, and the seat cushion is disposed on a top surface of the lifting seat; two liftable clamping members and two buttons are disposed in the lifting seat, wherein the two buttons are configured to correspondingly drive the two liftable clamping members to rise and lower; two groups of clamping ladders are disposed on side surfaces of the base, and each group of clamping ladders of the two groups of clamping ladders corresponds to each liftable clamping member of the two liftable clamping members; each clamping ladder of the two groups of clamping ladders is provided with a plurality of clamping slots, wherein the plurality of clamping slots are arranged at intervals from top to bottom; and the two liftable clamping members are engaged with the plurality of clamping slots, and wherein two receiving spaces are disposed between an outer side wall of the base and an inner side wall of the lifting seat, and a lifting member is disposed in the two receiving spaces, respectively; the lifting member is fixedly connected to the lifting seat a button of the two buttons is lifted and disposed on the lifting member, and each of the two liftable clamping members is disposed on the lifting member in the two receiving spaces.

2. The children's toilet bowl with the adjustable height of claim 1, wherein the button comprises a pressing portion and a driving rod; a top of the driving rod is connected to a bottom of the pressing portion; a lower part of the driving rod is provided with a first notch, and a bottom surface of the first notch is a first inclined surface; an inner side surface of the each liftable clamping member is provided with a second notch, and a side surface of the second notch is a second inclined surface attached to the first inclined surface; the inner side surface of the each liftable clamping member is provided with two clamping portions arranged at an interval; the lifting member is provided with a limiting slot adapted to the each liftable clamping member, and the each liftable clamping member is located in the limiting slot; two return springs are disposed between an outer side surface of the each liftable clamping member and an inner side surface of the lifting member; the each group of clamping ladders comprises two clamping ladders, and each clamping ladder of the two clamping ladders corresponds to each clamping portion of the two clamping portions; the each clamping portion is adapted to the plurality of clamping slots.

3. The children's toilet bowl with the adjustable height of claim 2, wherein an outer side surface of the lifting member is provided with a pressing groove, and the pressing groove is recessed inwardly to receive a hand; a top surface of the pressing groove is provided with a through groove adapted to the pressing portion; a back surface of the pressing groove is provided with two limiting posts; an upper part of the driving rod is provided with two slide grooves, and the two slide grooves correspond to and are adapted to the two limiting posts; the two limiting posts are correspondingly located in the two slide grooves, respectively; a locking member connected to the two limiting posts is disposed on an inner side of the driving rod.

4. The children's toilet bowl with the adjustable height of claim 2, wherein the side surfaces of the base are provided with two groups of clamping ladder slots, and each group of the two groups of clamping ladder slots comprises two clamping ladder slots; the each clamping ladder corresponds to and is adapted to each clamping ladder slot of the two clamping ladder slots, and the each clamping ladder is correspondingly located in the each clamping ladder slot; a back surface of the each clamping ladder slot is provided with a connecting protrusion, and a top surface of the connecting protrusion is provided with a first locking hole; a top surface of the each clamping ladder extends inwardly to form a connecting portion, and the connecting portion is provided with a second locking hole; the each clamping ladder is connected to the connecting protrusion after a screw passes through the second locking hole and the first locking hole.

5. The children's toilet bowl with the adjustable height of claim 1, wherein a middle portion of the seat cushion is provided with a toilet bowl receiving cavity, and the toilet bowl receiving cavity comprises an open top surface; a toilet bowl is placed in and adapted to the toilet bowl receiving cavity; a seat cushion ring and a toilet bowl cover are arranged on a top surface of the seat cushion, and the toilet bowl cover is hinged with the seat cushion; the toilet bowl cover is adapted to the seat cushion ring.

6. The children's toilet bowl with the adjustable height of claim 5, wherein a top surface of the seat cushion is provided with a plurality of embedded grooves, and a bottom surface of the seat cushion ring is provided with a plurality of embedding portions; each embedded groove of the plurality of embedded grooves corresponds to each embedding portion of the plurality of embedding portions, and the each embedding portion is correspondingly adapted to and located in the each embedded groove.

7. A children's toilet bowl with an adjustable height, comprising a base, a lifting seat, and a seat cushion;

wherein the lifting seat has a vertical through structure; an upper part of the base extends into the lifting seat, and the seat cushion is disposed on a top surface of the lifting seat two liftable clamping members and two buttons are disposed in the lifting seat, wherein the two buttons are configured to correspondingly drive the two liftable clamping members to rise and lower; two groups of clamping ladders are disposed on side surfaces of the base, and each group of clamping ladders of the two groups of clamping ladders corresponds to each liftable clamping member of the two liftable clamping members; each clamping ladder of the two groups of clamping ladders is provided with a plurality of clamping slots, wherein the plurality of clamping slots are arranged at intervals from top to bottom; and the two liftable clamping members are engaged with the plurality of clamping slots, and wherein each of a front end surface and a rear end surface of the base is provided with a limiting groove, and each of a front inner side surface and a rear inner side surface of the lifting seat is provided with a limiting protrusion; and the limiting protrusion is correspondingly located in the limiting groove.

8. A children's toilet bowl with an adjustable height, comprising a base, a lifting seat, and a seat cushion;

wherein the lifting seat has a vertical through structure; an upper part of the base extends into the lifting seat, and the seat cushion is disposed on a top surface of the lifting seat two liftable clamping members and two buttons are disposed in the lifting seat, wherein the two buttons are configured to correspondingly drive the two liftable clamping members to rise and lower; two groups of clamping ladders are disposed on side surfaces of the base, and each group of clamping ladders of the two groups of clamping ladders corresponds to each liftable clamping member of the two liftable clamping members; each clamping ladder of the two groups of clamping ladders is provided with a plurality of clamping slots, wherein the plurality of clamping slots are arranged at intervals from top to bottom; and the two liftable clamping members are engaged with the plurality of clamping slots, and wherein a protrusion is formed at a rear end of the seat cushion, and a cavity for placing paper towels is formed inside the protrusion; a rear end of the protrusion is provided with a placement opening; a rear cover covers on and is adapted to the placement opening; a top surface of the protrusion is provided with a paper extraction opening.

* * * * *